US008636308B2

(12) United States Patent
Calamia, III

(10) Patent No.: US 8,636,308 B2
(45) Date of Patent: Jan. 28, 2014

(54) GATE LATCH PULL CABLE

(76) Inventor: Eric Francis Calamia, III, Monte Sereno, CA (US)

( * ) Notice: Subject to any disclaimer, the term of this patent is extended or adjusted under 35 U.S.C. 154(b) by 206 days.

(21) Appl. No.: 12/759,698

(22) Filed: Apr. 14, 2010

(65) Prior Publication Data

US 2011/0254289 A1 Oct. 20, 2011

Related U.S. Application Data

(60) Provisional application No. 61/170,770, filed on Apr. 20, 2009.

(51) Int. Cl.
*E05C 3/16* (2006.01)
*E05C 3/12* (2006.01)

(52) U.S. Cl.
USPC ..... 292/235; 292/225; 292/DIG. 29

(58) Field of Classification Search
USPC ..... 292/125, 133, 194, 195, 219, 220, 225, 292/235, 240, DIG. 29, DIG. 53, DIG. 54, 292/DIG. 61, DIG. 63, 80, 84, 122, 203, 292/204, 209, 297, 298, 340, 341.15, 292/341.17; 49/354, 355, 356; 24/265 R, 24/265 EC; 403/154, 161–163, 316, 319; 256/73; 70/137
See application file for complete search history.

(56) References Cited

U.S. PATENT DOCUMENTS 155,574 A * 10/1874 Duesler ..... 292/227
1,313,368 A * 8/1919 Cesen ..... 24/376
2,249,272 A * 7/1941 Dey ..... 292/357
2,639,944 A * 5/1953 Higginbotham ..... 222/529
3,042,944 A * 7/1962 Basey et al. ..... 441/72
3,266,831 A 8/1966 Banse
3,433,518 A 3/1969 Foltz
3,498,156 A * 3/1970 McAllister et al. ..... 477/165
3,549,834 A * 12/1970 Spillar ..... 200/48 R
4,576,213 A * 3/1986 Miller ..... 144/371
5,078,438 A 1/1992 Bieganski
5,129,691 A * 7/1992 McFarlen ..... 292/214
5,195,569 A * 3/1993 Peterson et al. ..... 160/84.06
5,358,292 A 10/1994 Van Wiebe et al.
5,498,041 A 3/1996 Bezzerides et al.
5,655,801 A * 8/1997 Casey ..... 292/210
5,699,884 A * 12/1997 Koch et al. ..... 188/196 B (Continued)

OTHER PUBLICATIONS

"Du-Bro RC—2-56 Kwik Links;" http://shop.dubro.com/p/2-56-solder-kwik-links-qty-pkg-2.*

*Primary Examiner* — Carlos Lugo
*Assistant Examiner* — Alyson M Merlino

(57) ABSTRACT

One embodiment of an improved gate latch pull cable of the type being made of metal for durability and having a one-piece clevis clip secured to one end for easy attachment to a gate latch, and a pull loop secured with a cable sleeve on the other end for securely grasping the cable. The clevis clip incorporates an integral clevis pin eliminating loose parts, and a fillet transition to the cable to prevent it from catching on edges. Surrounding the cable is a tapered return-spring which assists in gate latch closure, and a spring cup which fits in a gate post hole for centering the large diameter of the spring over the hole. The small diameter of the spring is proximal to the clevis clip, and lightly pushes against a gate latch cam. The tapered spring coils fit inside each other when compressed allowing the gate latch to fully open.

6 Claims, 4 Drawing Sheets

(56) References Cited

U.S. PATENT DOCUMENTS

| | | | | |
|---|---|---|---|---|
| 5,868,446 | A * | 2/1999 | Rossmo | 292/341.17 |
| 6,058,747 | A * | 5/2000 | Doyle et al. | 70/137 |
| 6,170,892 | B1 | 1/2001 | Lantiegne | |
| 6,360,405 | B1 * | 3/2002 | McDaid et al. | 24/265 R |
| 6,364,566 | B1 * | 4/2002 | Broberg | 403/155 |
| 6,604,883 | B2 * | 8/2003 | Broberg | 403/154 |
| 6,666,054 | B1 * | 12/2003 | Hsieh | 70/257 |
| 7,021,678 | B1 * | 4/2006 | Raoult | 292/63 |
| 7,878,558 | B1 * | 2/2011 | Bell | 292/80 |
| 7,883,124 | B2 * | 2/2011 | Gephart et al. | 292/210 |
| 2004/0207136 | A1 * | 10/2004 | Adoline et al. | 267/168 |

* cited by examiner

GATE LATCH PULL CABLE

CROSS-REFERENCE TO RELATED APPLICATIONS

This application claims the benefit of U.S. provisional patent application Ser. No. 61/170,770 filed Apr. 20, 2009 by the present inventor.

BACKGROUND

Prior Art

The following is a tabulation of some prior art that presently appears relevant:

| U.S. Patents | | | |
|---|---|---|---|
| Pat. No. | Kind Code | Issue Dates | Patentee |
| 3,266,831 | | Aug. 16, 1966 | Banse |
| 3,433,518 | | Mar. 18, 1969 | Foltz |
| 5,078,438 | | Jan. 07, 1992 | Bieganski |
| 5,358,292 | | Oct. 25, 1994 | Van Wiebe et al. |
| 5,498,041 | | Mar. 12, 1996 | Bezzerides et al. |
| 6,170,892 | B1 | Jan. 09, 2001 | Lantiegne |

Gravity style gate latches are among the most commonly used residential gate latches. They are also referred to as automatic gate latches. They latch automatically when a gate is closed and hold the gate in the closed position. Closing the gate causes the latch mechanism to rise. Gravity then pulls it down, latching the gate closed.

Originally automatic gate latches were intended to be opened from the opposite side of the gate with a string. For example, U.S. Pat. No. 3,433,518 to R. E. Foltz (1969) shows the use of a string to open the latch. Due to the constant exposure to the outdoor elements, the string deteriorates, weakens and breaks. Sometimes gate latches stick or bind, requiring more pulling force to open than a string can offer. This makes opening a gate unreliable. Once the string is broken the gate can only be opened by reaching over to unlatch it or going around the house to open it from the back side. If the gate is tall or the person is short, reaching over the gate may not be an option. In addition, the string is limited to a pulling force and cannot provide any pushing assistance to ensure a positive closure. If the gate is slammed closed the latch mechanism cannot act quickly enough to make a positive latch and the gate bounces open.

Despite many attempts to create a better device to open automatic gate latches from the opposite side, the string remains the standard and by far the most commonly used device.

As can be seen, there is a need for a gate latch pull cable that is stronger, more durable and more reliable. To compete with a string it also needs to be inexpensive, easy to install and easy to use. To offer more value and security it needs to assist in positive latching.

Several types of gate latch pull cables have been proposed: U.S. Pat. No. 5,358,292 to Van Wiebe et al. (1994) is a gate latch pull which requires a significant amount of tooling to manufacture all of the plastic components. This increases the manufacturing cost and complexity, making it difficult to compete with a string. It is made of plastic, which will deteriorate in constant exposure to sunlight. This makes it prone to breakage and unreliable. It pulls up on the gate latching mechanism rather than pulling straight back, making it harder to pull and harder to open the latch fully. In addition, the spring pressure is too strong and causes the gate to bounce back open if the gate is not closed hard enough. This design is an attempt to solve the positive latching problem, but actually makes it worse because of the excessive spring pressure. Furthermore the spring and cable pull used in his design bunches up in one embodiment and bends more than 90 degrees in another. Both of these designs require excessive pull force resulting in an inconsistent latch mechanism release and in some cases a broken plastic cable.

U.S. Pat. No. 6,170,892 to Lantiegne (2001) does not offer the strength, durability, reliability or automatic positive latching capabilities. It is not designed for a significant pull force if the gate latch is stuck or binding. With a significant pull force, Lantiegnes' cable pull will slide off of the latch mechanism. Even with UV additives, plastic eventually breaks down in sunlight and overtime the gate latch pull will weaken and break. The other attachment methods in his patent are also prone to breaking with constant exposure to sunlight. Whether his gate latch pull is made of plastic or metal it is still lacking an automatic spring force to assist in the positive closure of the gate latch. A gate latch pull without a spring return acts as a dampener because of the additional weight and friction. This additional drag slows down the gate latch action and hinders positive gate latch closure if the gate is closed quickly.

U.S. Pat. No. 5,498,041 to Bezzerides et al. (1996) requires a separate spring on the latch to assist with latch closure rather than having an independent spring as part of the cable pull. This makes the cable pull dependent on the latch. If the automatic latch does not have a return-spring the cable will not offer return assistance and will also act as a damper. Some of the gate latch pull parts in Bezzerides patent are very small, loose parts that are easy to drop and tedious to install. Additionally, Bezzerides patent shows a push pad on the gate latch. If the gate latch does not have a push pad the sharp ends of the small gate latch pull parts will cause discomfort to the individual pushing the latch open. Stanley Co., one of the largest suppliers of gate hardware, offers an automatic gate latch #SP-1101 that does not have a push pad.

SUMMARY

In accordance with one embodiment a gate latch pull cable comprises a cable having a pull loop at one end held in place with a cable sleeve, a clevis clip incorporating an integral attachment pin on the other end, a tapered return-spring and a self aligning spring cup surrounding the cable at the clevis end.

ADVANTAGES

Accordingly several advantages of one or more aspects are as follows: to provide a gate latch pull cable that is easy and affordable to manufacture, that will allow a retail price point that is in-line with the cost of the gate latch, that is easy to install, that is strong, durable and reliable, that will stand up to the elements, that assists in positive gate latch closure, that eliminates gate latch bounce back, and is easy to pull. Other advantages of one or more aspects will be apparent from a consideration of the drawings and ensuing description.

DRAWINGS

Figures

FIG. 1: is a perspective view of the invention 10.

FIG. 2: is a side view of the invention 10.

FIG. 3: is a front view of the invention 10.

FIG. 4: is a top view of the invention 10.

FIG. 5: is a side view of the invention 10.

FIG. 6: is a detail perspective view illustrating the clevis clip 16

DRAWINGS

Reference Numerals

Figure 1:
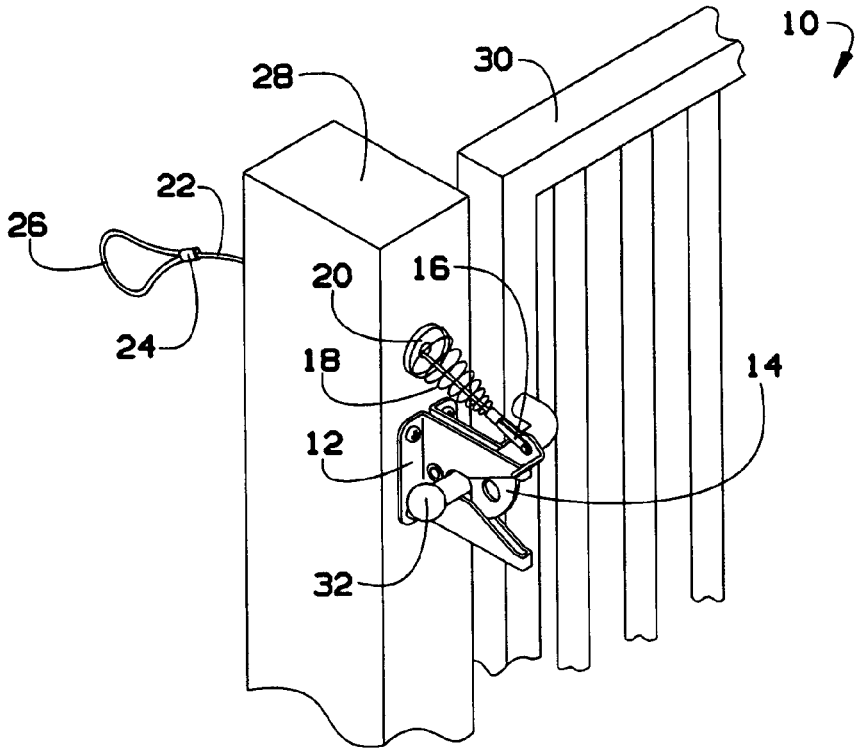
Figure 2:
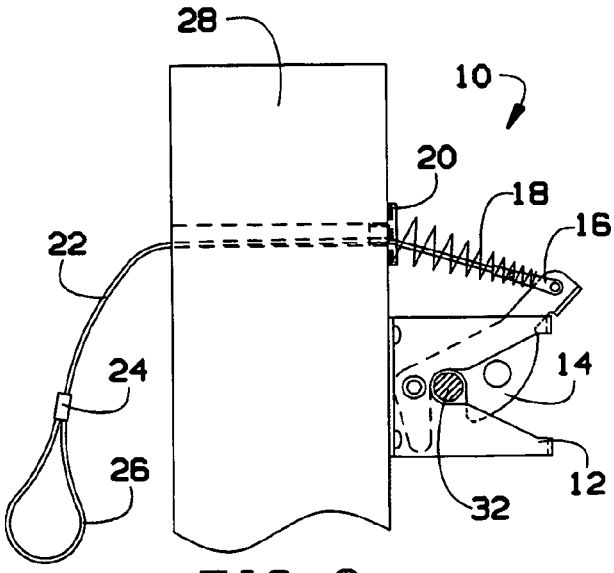
Figure 3:
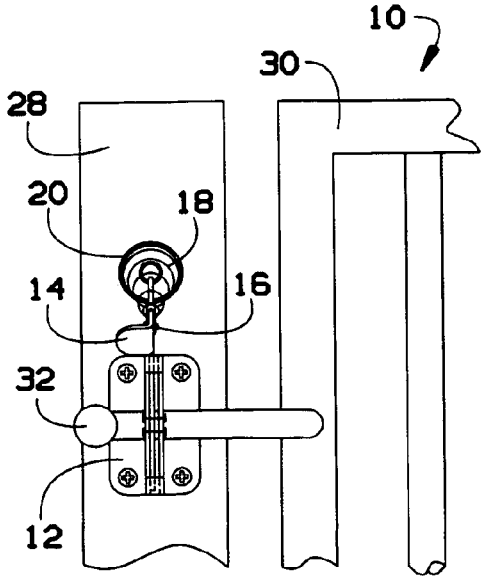
Figure 4:
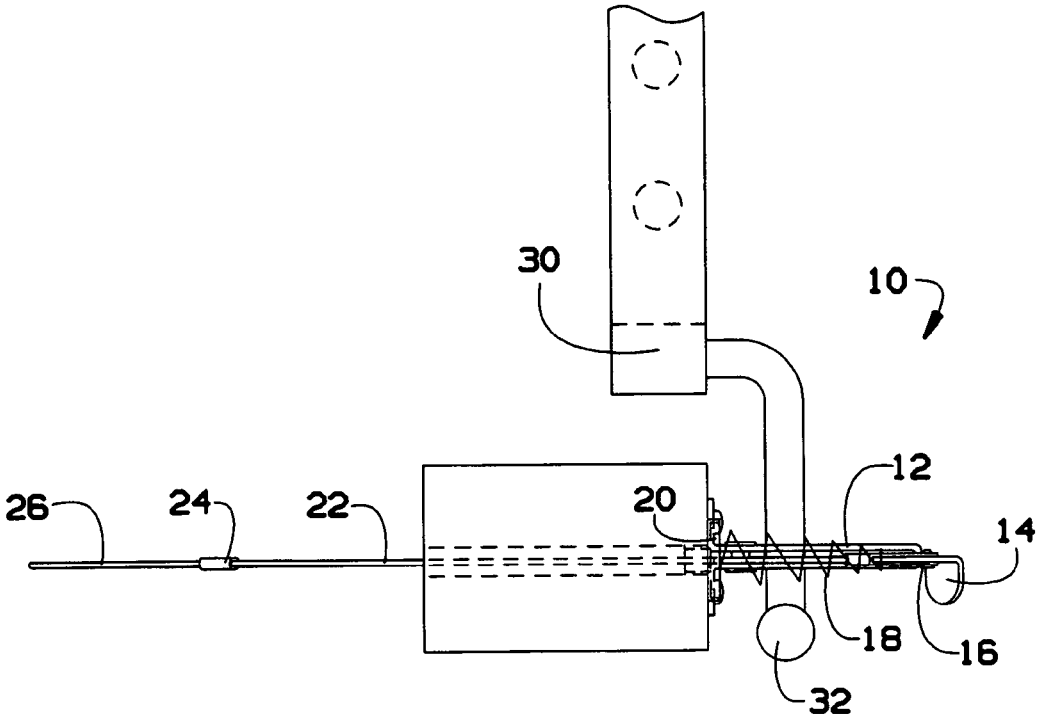

10 overall invention
12 gate latch assembly
14 gate latch cam
16 clevis clip
  16*a* filet
  16*b* barrel
  16*c* flat side
  16*d* clevis pin
  16*e* opposing flat side
  16*f* hole
18 tapered return-spring
20 spring cup
22 cable
24 cable sleeve
26 pull loop
28 gate post
30 gate
32 gate latch bar

DETAILED DESCRIPTION OF THE INVENTION

The following detailed description is my present contemplated mode of carrying out an exemplary embodiment of the invention. The description is not to be taken in a limiting sense, but is made for the purpose of illustrating the general principles of the invention, since the scope of the invention is best defined by the appended claims.

I presently contemplate for this embodiment an elongated cable 22 that passes through a hole in a gate post 28. The cable comprises a pull loop 26 at a first end which is secured with a cable sleeve 24. A clevis clip 16 is secured at the second end. The clevis clip comprises a fillet 16*a*, a barrel 16*b*, a flat side 16*c* and a clevis pin 16*d* which is affixed to the flat side 16*c*. An opposing flat side 16*e* has a hole 16*f* to receive the clevis pin 16*d*. The clevis clip 16 is attached to a gate latch cam 14 which pivots inside a gate latch assembly 12 and latches on to a latch bar 32 which is attached to a gate 30. A tapered return-spring 18 surrounds the cable 22 and is situated proximal to the gate latch assembly 12. The larger diameter of the tapered return-spring 18 rests in a spring cup 20 which surrounds the cable 22 and is situated in the hole in the gate latch post 28. The smaller diameter of the tapered return-spring 18 presses against the gate latch cam 14.

Operation—Referring to FIGS. 1, 2, 3, 4, 5, 6, 7, and 8.

An exemplary embodiment may be made and used according to the following description.

The present invention provides a mechanism to open the gate latch from the outside of the gate. The pull loop 26 in cable 22 is grasped and pulled back which pulls on the clevis clip 16 compressing the tapered return-spring 18 and opening the gate latch cam 14 fully so the gate latch bar 32 attached to gate 30 can be released and gate 30 is opened. Once the gate 30 is opened, the pull loop 26 is released and the tapered return-spring 18 assists the gate latch cam 14 to return to the closed position. Next, the gate 30 is closed and the gate latch bar 32 pushes the gate latch cam 14 up and against the light force of the tapered return-spring 18 and then the tapered return-spring 18 pushes back and assists the closure of the gate latch cam 14 which captures the gate latch bar 32, securing the gate 30 closed.

Cable 22: The gate latch pull cable 22 may be approximately 14" long, is made of multiple strand, flexible, 1/16" inch in diameter, stainless steel cable. The cable has a pull loop 26 on one end for grasping it. The cable 22 may be 304 stainless steel, 7×7 stranded wire available at West Coast Wire and Rigging, 597 85th Ave., Oakland, Calif. 94621. The cable may be cut to the desired length using a Felco cutter, model number C-7 available from Lexco Cable Mfg., 7320 West Agatite Ave., Norridge, Ill. 60706.

Pull Loop 26: The pull loop 26 in the cable may be approximately 2" long and held in place by crimping the cable sleeve 24 onto the cable. The pull loop 26 can be formed by hand and the cable sleeve 24 is slid over the cable and may be crimped with a standard cable crimping tool number 1-3-SBHS, available from Lexco Cable Mfg., 7320 West Agatite Ave., Norridge, Ill. 60706.

Cable sleeve 24: The cable sleeve 24 may be made from copper and crimped onto the cable 22 to hold the pull loop 26 in place. The cable sleeve 24 is a standard product #S-10-001 available from US Rigging, 4001 W. Carriage Dr. Santa Ana, Calif. 92704.

Clevis Clip 16: The clevis clip 16 is small enough to fit through a ¼" diameter hole in the gate post and a ¼" hole in the spring cup. It may be hardened, high carbon steel or stainless steel which may be silver soldered onto the end of the cable 22 opposite the pull loop 26. Stay-Brite silver solder #SB11 may be used in conjunction with Stay-Clean soldering flux #40004 which are both available from J.W. Harris Co., Inc., Mason, Ohio 45040. The clevis clip is soldered to the cable by sliding the barrel 16*b* of the clevis clip 16 over the cable 22. The soldering flux is applied where the cable 22 meets the clevis clip 16. Heat is applied, with a small butane torch such as the Bernz-o-matic #019133ST2200T, to the same area until the flux starts to bubble then the solder is dabbed on until it melts and wicks up into the barrel 16*b* of the clevis clip 16. After the solder is cooled with a few drops of distilled water, flux and heat are applied again and another dab of solder is applied to create a fillet 16*a* between the cable 22 and end of the barrel 16*b* on the clevis clip 16. To attach the clevis clip 16 to the gate latch cam 14, the flat side 16*c* and the opposing flat side 16*e* of the clevis clip 16 are spread apart and the clevis pin 16*d* is lined up over the hole in the gate latch cam 14 and released causing the pin to go through the hole in the gate latch cam 14 and through the hole in the opposing flat side 16*e* of the clevis clip 16 attaching it securely to the gate latch cam 14. The clevis clip 16 is a standard product. It is part number 112. It is called a 2-56 solder kwik-link available from Du-Bro Products, 480 Bonner Rd., Waconda, Ill., 60084. It is made by forming sheet metal with dies. Once the clevis clip 16 has been formed it is heat treated for strength and then plated with Nickel.

Figure 5:
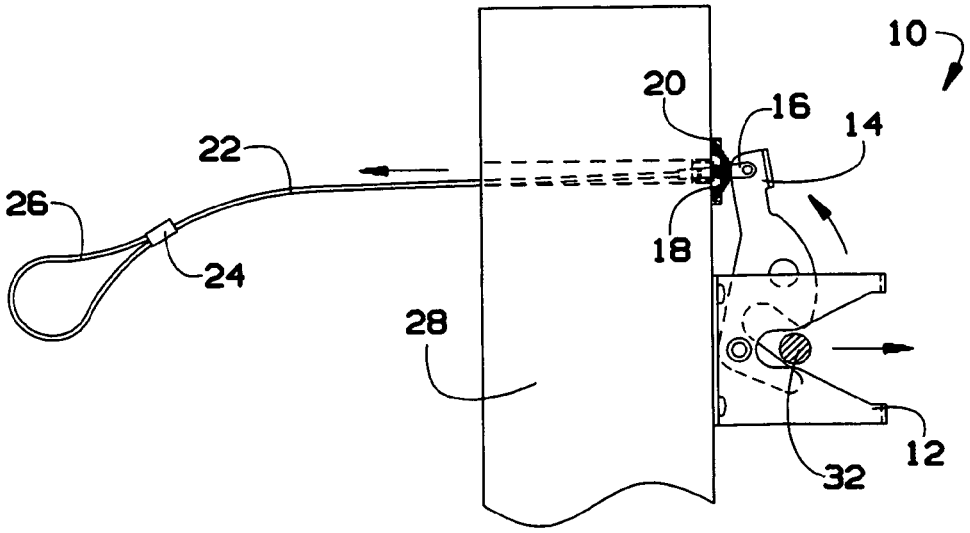
Figure 6:
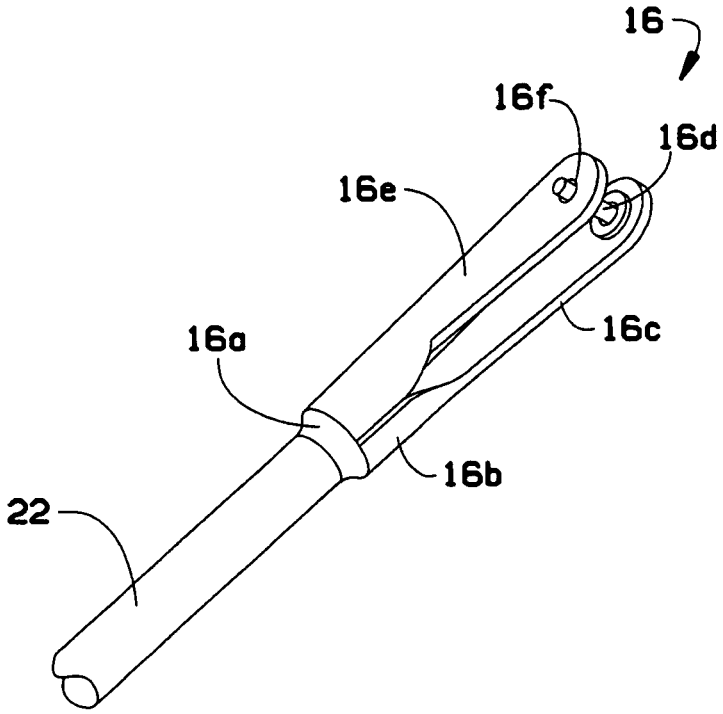
Figure 7:
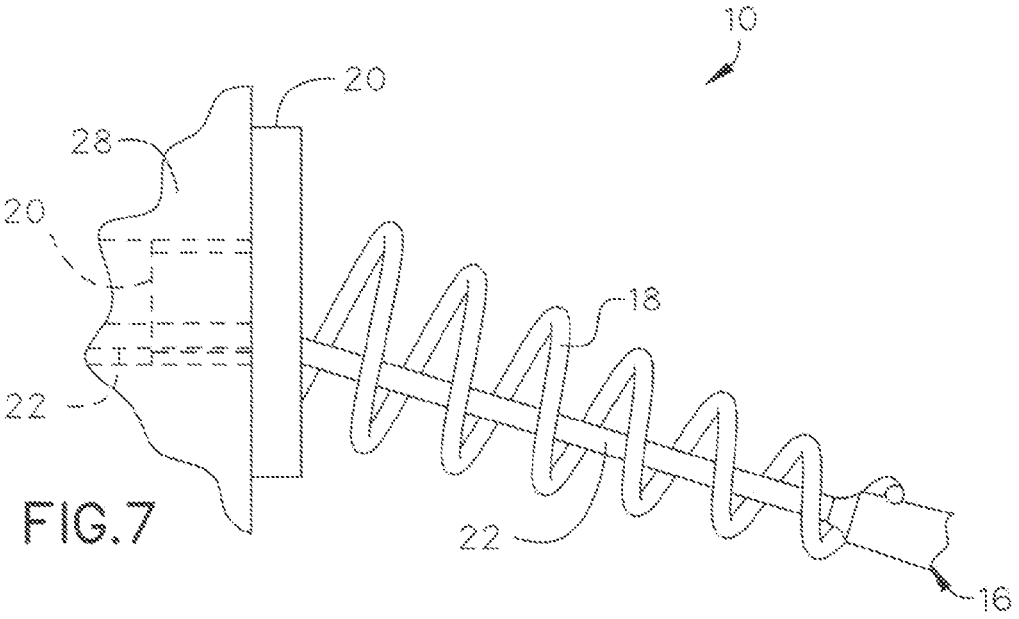
FIG. 7 is a view of the tapered spring in an extended configuration.
Figure 8:
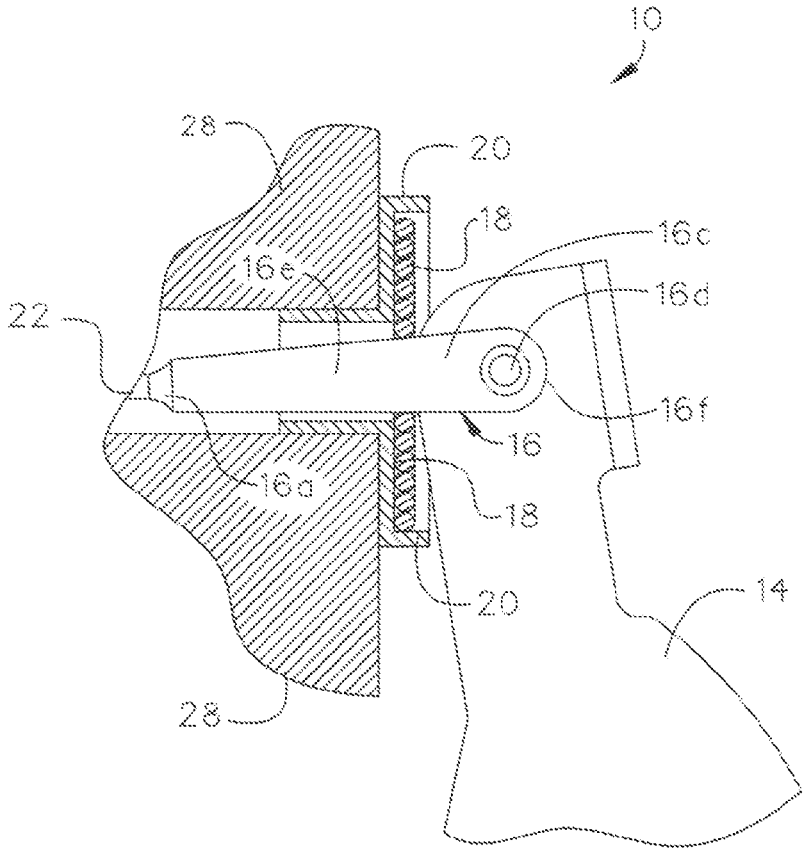
FIG. 8 is a view of the tapered spring in a collapsed configuration.

Tapered return-spring 18: The tapered return-spring 18 may be made of stainless steel. It is conically shaped so it can completely collapse on itself and not interfere with the gate latch cam 14 being pulled all the way open. When the tapered return-spring 18 is completely collapsed (see, e.g., FIG. 8), the coils of the spring fit inside of each other and it can be compressed down to the thickness diameter of the spring wire, which may be about 0.020". FIG. 5, and more particularly FIG. 8, shows the tapered return-spring's 18 ability to fully compress while the cable 22 is pulled straight back, in direct alignment with the attachment hole in the gate latch cam 14 that the clevis clip 16 attaches to. The tapered return-spring 18, in one example, is a custom spring and can be made to specification by standard spring manufacturing techniques by various spring manufacturing companies such as Century Spring, 222 16$^{th}$ St. Los Angles, Calif. 90015. Century Spring has assigned this custom made tapered return-spring 18 part number SPC47333.

Spring Cup 20: The spring cup 20 is used to hold the large diameter of the tapered return-spring 18 so it stays centered over the hole in the gate post 28. The spring cup 20 may be made of mild steel, case hardened to reduce friction and then plated with nickel to prevent rust. The spring cup 20 may be manufactured on a lathe to specifications by a machine shop such as Edward Koehn Company Inc., 820 Folger Ave, Berkeley, Calif. 94706.

Advantages

From the description above, a number of advantages of one embodiment of my gate latch pull cable become evident:

(a) Easy and inexpensive to manufacture: The gate latch pull cable is easy to make. It doesn't require extensive tooling. The cable, cable sleeve and clevis clip are "off the shelf" commercially available parts. Only the tapered return-spring and the spring cup are custom parts and they can be made with popular, standard manufacturing techniques. Because of this, the gate latch pull cable can be made at a competitive and reasonable price point.

(b) Strong, durable and reliable: All Steel construction makes it strong, durable and reliable. It won't break down in sunlight like a string or a plastic pull. If the gate latch binds, the cable can be pulled hard without worry of breaking.

(c) Better security: The tapered return-spring provides a light return force to the gate latch cam which ensures positive gate latching and eliminates gate bounce back. It also allows the gate latch cam to fully open because the tapered return-spring's coils fit in-between each other and can completely collapse. A regular coil compression spring does not have this capability because the spring coils stack up on each other when compressed. The completely collapsing tapered return-spring also allows the pull force to be directly behind the gate latch cam attachment hole. The direct alignment provides a consistently smooth and even pull on the gate latch cam. The tapered return-spring is strong enough to overcome the additional weight, dampening effect and friction caused by adding a gate latch pull to the gate latch cam but not strong enough to require the gate to be slammed to overcome the spring force.

(d) Easy to install: The one piece Clevis Clip with the affixed, integral clevis pin allows for a quick, easy, "no tools required" attachment to the gate latch cam. It has no small loose parts to drop or lose and it doesn't have any sharp parts, like a clevis pin clip, to get cut on. Its compact size allows for a small hole to be drilled in the gate post. Because it is made of hardened, high carbon steel it is strong and will not yield from a human pull force.

CONCLUSION, RAMIFICATIONS AND SCOPE

Accordingly, the reader will see that the gate latch pull cable can be used to replace the most commonly used devise which is an ordinary string. The low cost to manufacture, the durability, the ease of installation and the spring assisted closure make it an obvious choice over a string. The fact that more than 15,000 gate latch cables of this embodiment have been sold through 192 hardware stores during the term of the Provisional Patent are a clear testimonial to the need and acceptance of this design. The use of the tapered return-spring, the clip-on, one piece clevis and the all metal construction are the primary attributors to the success of the 15,000 gate latch cable pulls that have been sold.

I claim:

1. A gate latch pull cable assembly, comprising:

a metal cable with a gate latch attachment device on one end thereof, said gate latch attachment device being in the form of a clevis clip;

a grasping device on the other end of said metal cable;

a tapered return-spring having a first end with a larger diameter than a second end thereof, wherein said tapered return-spring comprises a plurality of coils of spring wire that are configured to collapse into a thickness of a single spring wire layer thereof in response to pulling on said grasping device; and a spring cup that situates said first end of said tapered return-spring over the center of a hole in a gate post, wherein said spring cup is configured to enclose said collapsed plurality of coils of spring wire in response to said grasping device being pulled.

2. The gate latch pull cable assembly of claim 1, wherein said metal cable comprises a multi-stranded stainless steel cable whereby said metal cable is resistant to degradation from sunlight and rust.

3. The gate latch pull cable assembly of claim 1, wherein said grasping device comprises a pull loop formed in said metal cable, wherein said pull loop is approximately 2" long and 1" wide to enable a user to securely grasp said metal cable.

4. The gate latch pull cable assembly of claim 3, wherein said grasping device comprises a cable sleeve constructed with copper and crimped to securely hold said pull loop.

5. The gate latch pull cable assembly of claim 3, wherein said clevis clip is attached to said one end of said metal cable opposite said other end of said metal cable in which said pull loop is formed, and wherein said clevis clip comprises an integral clevis pin small enough to pass through the hole in the gate post such that a user can clip said metal cable onto a gate latch cam without tools or additional parts.

6. The gate latch pull cable assembly of claim 1, wherein said clevis clip comprises a fillet with a barrel end of said clevis clip to provide a ramped transition from said metal cable to said clevis clip to prevent an edge of said barrel end of said clevis clip from catching on a spring coil, a sharp edge, or a spring cup hole.

* * * * *